US006113355A

United States Patent [19]

Hult et al.

[11] Patent Number: 6,113,355

[45] Date of Patent: Sep. 5, 2000

[54] PUMP DRIVE HEAD PUMP ASSEMBLY WITH A HYDRAULIC PUMP CIRCUIT FOR PREVENTING BACK-SPIN WHEN THE DRIVE HEAD HAS BEEN SHUT OFF

[75] Inventors: Vern Arthur Hult; Edward Leigh Schubert, both of Calgary, Canada

[73] Assignee: Weatherford Holding U.S., Inc., Houston, Tex.

[21] Appl. No.: 08/948,811

[22] Filed: Oct. 9, 1997

[30] Foreign Application Priority Data

Oct. 10, 1996 [CA] Canada ..... 2187578

[51] Int. Cl.[7] ..... F04B 49/00; E21B 43/00

[52] U.S. Cl. ..... 417/214; 417/26; 417/199.1; 166/68

[58] Field of Search ..... 417/26, 214, 199.1, 417/441, 292; 418/3; 166/68, 68.5

[56] References Cited

U.S. PATENT DOCUMENTS

| | | | |
|---|---|---|---|
| 1,917,821 | 7/1933 | Branstrator | 166/68.5 |
| 2,107,481 | 2/1938 | Johnson | 103/102 |
| 3,146,717 | 9/1964 | Tyree | 418/3 |
| 3,263,425 | 8/1966 | Rohde | 418/206.1 |
| 3,370,540 | 2/1968 | Carpenter | 418/3 |
| 4,424,887 | 1/1984 | Sommer | 188/264 P |
| 4,500,268 | 2/1985 | Sunberg et al. | 418/1 |
| 4,797,075 | 1/1989 | Edwards et al. | 418/48 |
| 4,993,276 | 2/1991 | Edwards | 74/411.5 |
| 5,143,153 | 9/1992 | Bach et al. | 166/68.5 |
| 5,167,491 | 12/1992 | Keller et al. | 417/28 |
| 5,358,036 | 10/1994 | Mills | 166/68.5 |
| 5,551,510 | 9/1996 | Mills | 166/68 |
| 5,749,416 | 5/1998 | Belcher | 166/68.5 |

FOREIGN PATENT DOCUMENTS

| | | | |
|---|---|---|---|
| 561428 | 8/1958 | Canada . | |
| 561982 | 8/1958 | Canada . | |
| 1072174 | 2/1980 | Canada | H02H 7/04 |
| 1229271 | 11/1987 | Canada . | |
| 1279256 | 1/1991 | Canada | E21B 43/00 |

*Primary Examiner*—Charles G. Freay
*Assistant Examiner*—Robert Z. Evora
*Attorney, Agent, or Firm*—Hayes, Soloway, Hennessey Grossman & Hage PC

[57] ABSTRACT

A pump drive head includes a housing, and a main shaft carried on upper and lower bearings disposed in the housing. The main shaft includes an outer torque tube and a liner tube. The outer and liner tubes abut along a first portion of their length and are separated along a second portion of their length forming a double wall with an elongate tubular space in between. A standpipe is coupled at one end to the housing, below the lower bearing, and received by the elongate tubular space an eliminates the need for a lower seal on the main shaft. A hydraulic pump includes a hydraulic pump chamber displosed in the housing and communicating with the main shaft, and first and second gears disposed in the hydraulic pump chamber and the first gear coupled to the main shaft. The second gear intermeshes with the first gear. A suction port is located between the first and second gears and operable when the main shaft is rotated in a reverse direction from the normal pumping direction, during a condition known as backspin. A hydraulic circuit coupled to the suction port provides resistance to the reverse direction of rotation of the main shaft. The hydraulic circuit includes a variable orifice, for adjusting tje desired reverse rotation speed in series with a wax motor actuator for temperature sensitive control of reverse rotation speed.

21 Claims, 4 Drawing Sheets

PUMP DRIVE HEAD PUMP ASSEMBLY WITH A HYDRAULIC PUMP CIRCUIT FOR PREVENTING BACK-SPIN WHEN THE DRIVE HEAD HAS BEEN SHUT OFF

FIELD OF THE INVENTION

The present invention relates to pump drive heads and is particularly concerned with drive heads for screw pumps.

BACKGROUND OF THE INVENTION

It is well known to use screw pumps in deep well applications such as pumping oil from wells. There are a number of challenges presented by the use of screw pumps with which existing well head drives are intended to deal. It is necessary to control the backspin that occurs on shutting down a well. Backspin is caused by two energy storage systems, inherent in deep well screw pump operation. The first energy storage system results from a fluid head in the well that on shutting off the pump drive effectively turns the screw pump into a motor. The second energy storage system results from the torsional spring action of the sucker rods linking the drive head to the screw pump. Current drive heads provide a mechanism for mitigating the backspin caused by these stored energy systems. However, present solutions may be less effective and require higher maintenance than desirable.

SUMMARY OF THE INVENTION

An object of the present invention is to provide an improved pump drive head.

In accordance with an aspect of the present invention there is provided a pump drive head comprising a housing, a main shaft rotatably coupled to the housing with a connection to a pump driving rod, a hydraulic pump connected to the main shaft, and a hydraulic circuit connected to the hydraulic pump, the hydraulic pump having first and second directions of operation, the first direction pumping no fluid through the hydraulic circuit, thereby providing a relatively low resistance to rotation of the main shaft, the second direction pumping fluid through the hydraulic circuit, thereby providing a relatively high resistance to rotation of the main shaft.

In accordance with another aspect of the present invention there is provided a pump drive head comprising a housing, upper and lower bearings disposed in the housing, a main shaft received by the upper and lower bearings, a hydraulic pump including a hydraulic pump chamber displosed in the housing and communicating with the main shaft, a first gear disposed in the hydraulic pump chamber and coupled to the main shaft, a second gear disposed in the hydraulic pump chamber and intermeshing the first gear, and a suction port located between the first and second gears and operable for one direction of rotation of the main shaft, and a hydraulic circuit coupled to the suction port for resisting said one direction of rotation of the main shaft.

In accordance with a further aspect of the present invention there is provided a pump drive head comprising a housing, upper and lower bearings disposed in the housing, a main shaft received by the upper and lower bearings, the main shaft includes an outer tube and a liner tube, wherein the outer and liner tubes abut along a first portion of their length and are separated along a second portion of their length thereby forming an elongate tubular space, and a standpipe coupled at one end to the housing, below the lower bearing, and received by the elongate tubular space between the outer and liner tubes of the main shaft.

In accordance with yet another aspect of the present invention there is provided a pump drive head comprising a housing, upper and lower bearings disposed in the housing, a main shaft received by the upper and lower bearings, the main shaft includes an outer tube and a liner tube, wherein the outer and liner tubes abut along a first portion of their length and are separated along a second portion of their length thereby forming an elongate tubular space, a backspin preventer coupled to the main shaft, and a standpipe coupled at one end to the housing, below the lower bearing, and received by the elongate tubular space between the outer and liner tubes of the main shaft.

In accordance with a still further aspect of the present invention there is provided a pump drive head comprising a housing, upper and lower bearings disposed in the housing, a main shaft received by the upper and lower bearings, the main shaft includes an outer tube and a liner tube, wherein the outer and liner tubes abut along a first portion of their length and are separated along a second portion of their length thereby forming an elongate tubular space, a standpipe coupled at one end to the housing, below the lower bearing, and received by the elongate tubular space between the outer and liner tubes of the main shaft, a hydraulic pump including a hydraulic pump chamber displosed in the housing and communicating with the main shaft, a first gear disposed in the hydraulic pump chamber and coupled to the main shaft a second gear disposed in the hydraulic pump chamber and intermeshing the first gear, and a suction port located between the first and second gears and operable for one direction of rotation of the main shaft, and a hydraulic circuit coupled to the suction port for resisting said one direction of rotation of the main shaft.

There are numerous advantages of the present invention and embodiments thereof. The hydraulic pump allows forward rotation and slows reverse rotaion. In the forward rotation direction very little resistance is introduced by the hydraulic pump. In the reverse direction, a variable resistance may be provided by introducing variable resistance in the hydraulic circuit coupled to the hydraulic pump. By having the hydraulic pump connected to the main shaft, mechanical devices, such as clutch, which are prone to mechanical wear, are eliminated. The variable resistance may be an ajustable orifice or a temperature sensitive component, for example a wax motor actuator. The use of a temperature sensitive component provides an automatic speed regulating circuit, thereby preventing overheading of the drive unit. Providing a double walled main shaft that receives a standpipe eliminates the need for a lower oil seal, thereby reducing maintenance and eliminating the chance of the drive losing oil which would jeopardize the operation of the hydraulic pump.

BRIEF DESCRIPTION OF DRAWINGS

The present invention will be further understood from the following description with references to the drawings in which.

DETAILED DESCRIPTION

Figure 1:
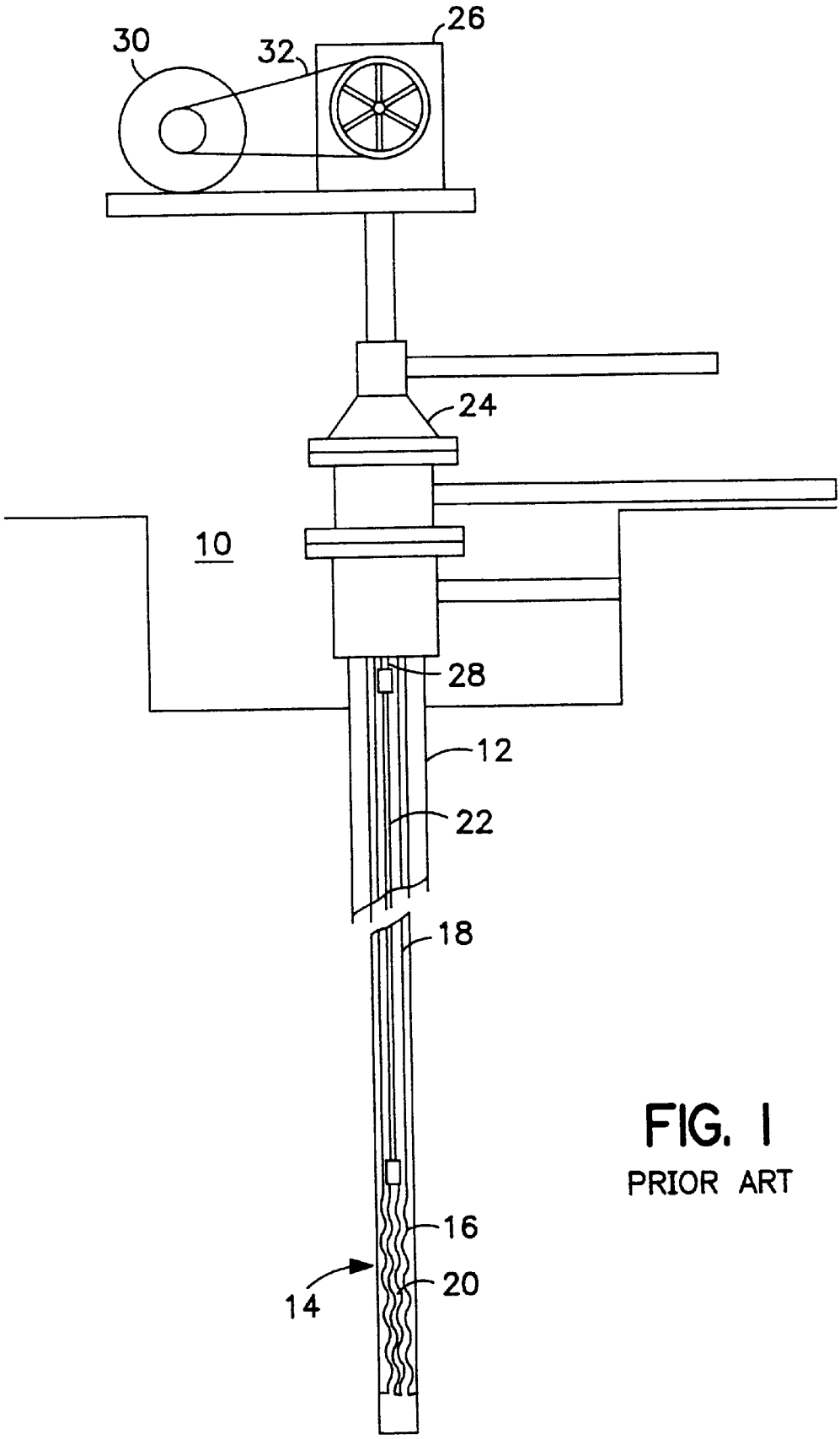
FIG. 1 PRIOR ART
FIG. 1 illustrates a known well pump installation.

Referring to FIG. 1, there is illustrated a known well pump installation. As is typical such installations include a well 10 having a casing 12, a screw pump 14 having a stator 1 6 coupled to a production tubing 18 and a rotor 20 coupled to a plurality of sucker rods 22. The production tubing and sucker rods extend the full height of the well 10 to the surface where the production tubing is terminated by a tubing head adapter 24. Mounted on top of the well pump installation is a drive head 26. The sucker rods 22 are coupled to a polished rod 28 below the tubing head adapter 24. The polished rod 28 extends up through the drive head 26, not shown in FIG. 1. The drive head is coupled to an electric motor 30, typically via a drive belt 32.

In operation, the electric motor 30 powers the drive head 26 that turns the pump rotor 20 via the polished rod 28 and the plurality of sucker rods 22.

Figure 2:
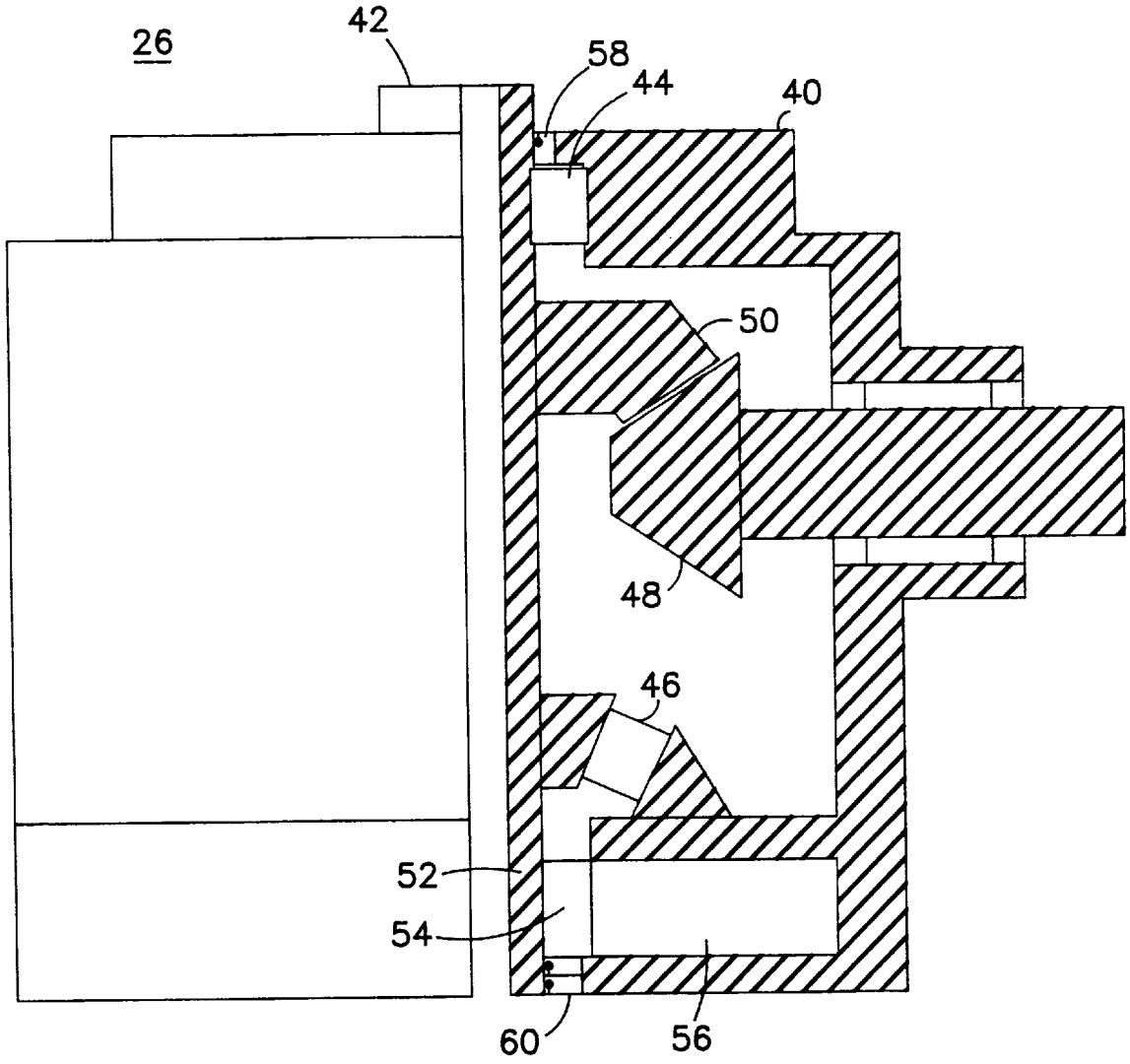
FIG. 2 PRIOR ART
FIG. 2 illustrates, in a front elevation and partial vertical cross-section, a known drive head.

Referring to FIG. 2 there is illustrated, in a front elevation and partial vertical cross-section a known drive head. The drive head 26 includes a housing 40 and a main shaft 42 extending the vertical height of the housing 40. The main shaft 42 is supported by bearings 44 and 46 and driven by bevel gears 48 and 50. Coupled to a lower portion 52 of the main shaft 42 is a cam clutch 54. The cam clutch 54, when engaged, couples with a hydraulic rotary vane pump 56. The main shaft 42 is sealed relative to the casing 40 by upper and lower seals 58 and 60, respectively.

In operation, the drive head 26 transfers power from the electric motor 30 of FIG. 1 to the main shaft 42 via bevel gears 48 and 50. On being shut down, energy stored in torsion of the plurality of sucker rods 22 and fluid head (not shown in the figures) causes backspin. Once backspin starts, the cam clutch 54 engages, coupling the main shaft 42 to the hydraulic rotary vane pump 56. The intended purpose of the vane pump 56 being to limit the speed of the main shaft 42 in a backspinning state. While this design is widely accepted within the industry, in relying on a mechanical clutch, it is prone to wear and therefore requires maintenance to meet its objective. In addition, depending upon ambient conditions, even when the clutch works properly, the speed of rotation in the backspinning condition may cause an overheating condition in the drive head due to friction in the hydraulic vane pump. The drive head 26 has an oil level to a height approximately at the middle of gear 48. Thus, the lower seal 60 between the housing 40 and the main shaft 42 is exposed to the full height of the oil in the drive head. Consequently, the lower seal may be prone to leaking or require more frequent replacement than desirable. If the seal leaks, there may be insufficient oil to provide the braking action required.

Figure 3:
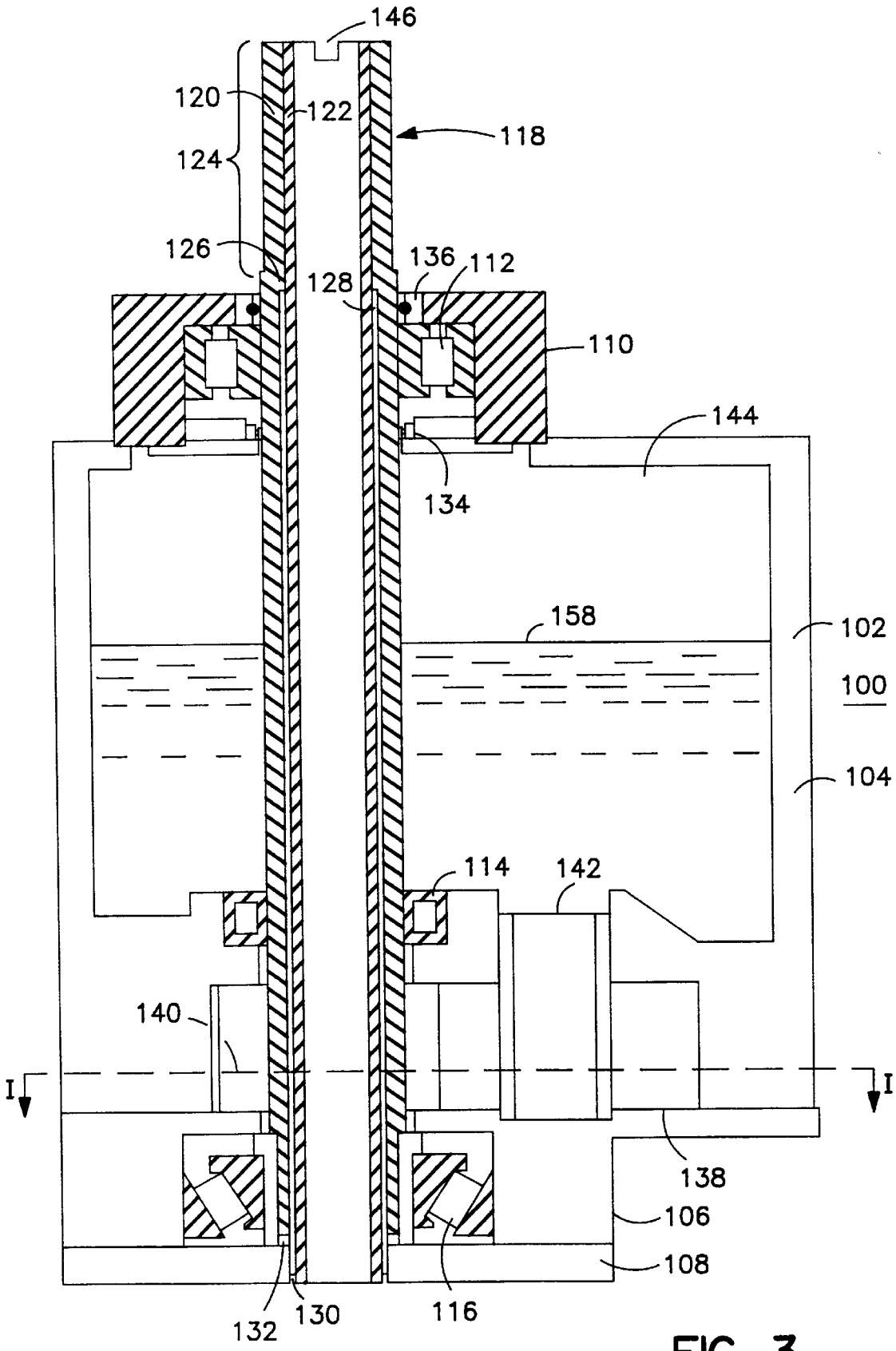
FIG. 3 illustrates, in a vertical cross-section, a drive head in accordance with an embodiment of the present invention.

Referring to FIG. 3 there is illustrated, in a vertical cross-section, a drive head in accordance with an embodiment of the present invention. The drive head 100 includes a housing 102 having a body 104, a lower bearing block 106, a plate 108 and an upper bearing block 110. Bearings 112, 114, and 116 carried in the upper bearing block 110, the body 104 and the lower bearing block 106, respectively, rotatably support a main shaft 118. The main shaft 118 includes an outer torque tube 120 and a liner tube 122. The outer torque tube 120 and the liner tube 122 abut for a length 124 intended to receive a V-belt sheave (not shown in FIG. 3). The outer torque tube 120 and the liner tube 122 form an elongate tubular space 126 that extends for approximately the entire height of the housing 102. Within the elongate tubular space 126 is mounted a standpipe 128. The standpipe 128 is, at its lower end, received and supported by a cylindrical aperture 130 in the plate 108. A lower seal 132 between the bearing carrier 116 and the standpipe 128 and an upper seal 134 between the upper bearing block 110 and the outer torque tube 120 effectively seal the housing and the main shaft for storage or shipping. An upper seal 136 provides a seal against moisture and dirt entry into the upper bearing 112, which is a greased bearing. The body 104 includes a hydraulic pump chamber 138 formed in a lower portion thereof and housing two gears, a first gear 140, keyed (not shown in FIG. 3) to the torque tube 120 of main shaft 118, and a second gear 142, driven by the first gear 142. Above the gears 140 and 142 and communicating therewith is an oil reservoir 144. The top of the main shaft 118 is provided with a position to clamp onto the polished rod 28 (neither clamp nor polished rod shown in FIG. 3).

Figure 4:
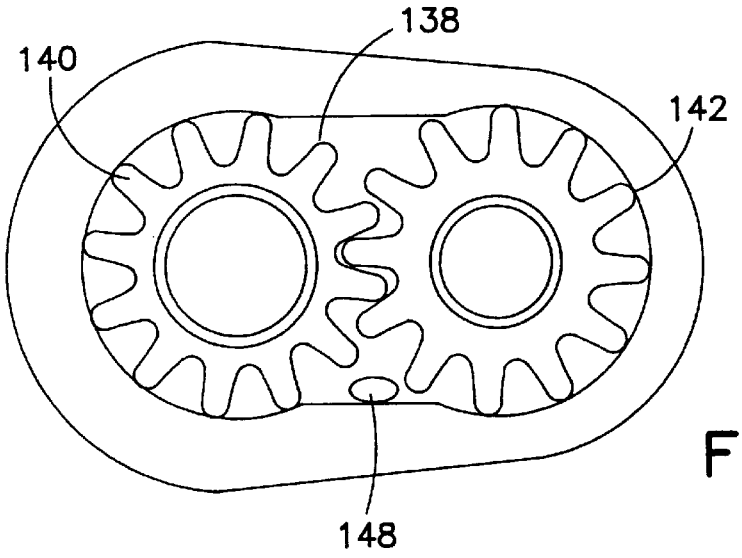
FIG. 4 illustrates, in a horizontal cross-section through I—I, the drive head of FIG. 3.

Referring to FIG. 4, there is illustrated, in a horizontal cross-section through I—I the drive head of FIG. 3. FIG. 4 shows the first and second gears 140 and 142, respectively, positioned within the hydraulic pump chamber 138. Between first and second gears 140 and 142 is provided a suction port 148. The suction port 148 is connected to a hydraulic circuit schematically illustrated in FIG. 5. The hydraulic circuit includes a hydraulic pump 150 formed by the hydraulic pump chamber 138, first and second gears 140 and 142 and the suction port 148, a variable orifice 152 and a wax motor actuator 154 serially connected between the suction port 148 and the reservoir 144 by a conduit 156. Operation of the drive head 100 is described with reference to FIGS. 3 through 5.

Figure 5:
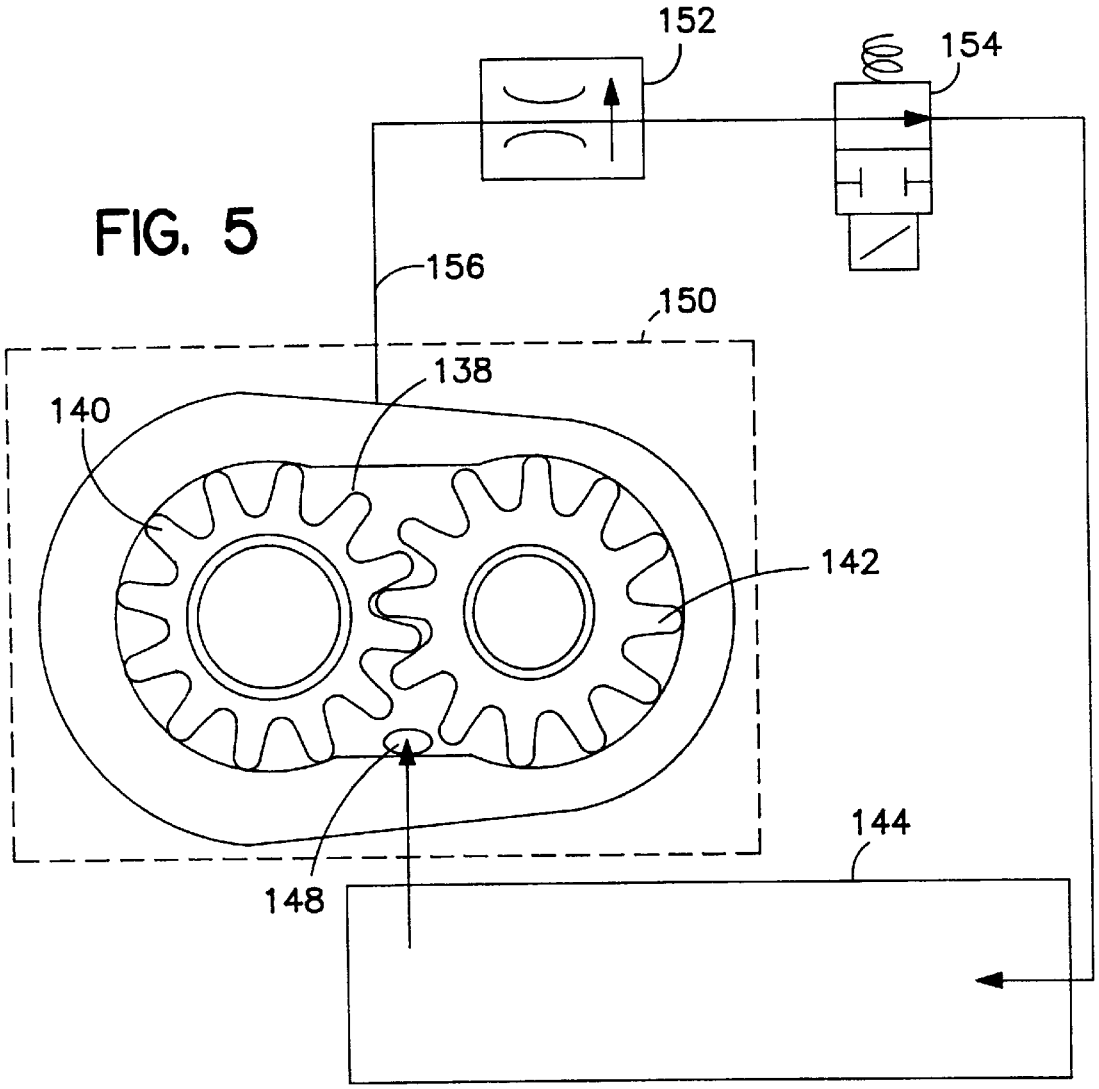
FIG. 5 schematically illustrates a hydraulic circuit in accordance with an embodiment of the present invention.

In operation, when the well is being pumped, the main shaft 118 is rotated in a clockwise direction. When rotated in the clockwise direction, oil from the reservoir 144 is not drawn into the suction port 148 and there is no corresponding suction port for such rotation. Consequently, the hydraulic circuit of FIG. 5 is not operative during well pumping operation, that is clockwise rotation. The first and second gears 140 and 142 when rotating under well pumping operation introduce low frictional losses because no fluid is circulated by the gears.

When well pumping is shut down, backspin is limited by the hydraulic pump 150. In the counter clockwise direction of rotation, the suction port 148 is operative, as is the hydraulic circuit of FIG. 5. The variable orifice 152 allows adjustment of the fluid flow rate within the circuit, thereby limiting the speed at which first and second gears 140 and 142 can rotate. As the first gear 140 is keyed to the outer torque tube 120, this effectively limits the speed of the main shaft 118. A second circuit component, the wax motor actuator 154 acts as a temperature sensitive speed controller. As the temperature of the oil increases, the wax motor actuator decreases its fluid passageway, further restricting the fluid flow rate and consequently, the rate of rotation of the main shaft 118. Thus, the hydraulic circuit of FIG. 5, automatically regulates the speed of backspin allowed at the head drive as a function of temperature, thereby preventing overheating of the drive head due to friction.

The oil level in the reservoir 144 as represented by a line 158 is at the same level on the standpipe 128 as the lower seal 132, which prevents oil from leaking out of the housing during shipping and storage, allows the passage of oil into the gap between the standpipe 128 and the torque tube 122. The standpipe 128 thereby eliminates the reliance upon a lower seal in an operational position. Preferrably, the standpipe 128 is made of bronze, thus allowing greater tolerances in positioning relative to the main shaft.

While not shown in the drawings, the liner tube 122 may be supported at its lower end by an additional bearing. The purpose of this bearing being to provide extra support of the liner tube to offset loading from a bent polished rod.

Numerous modifications, variations, and adaptaions may be made to the particular embodiments of the invention described above without departing from the scope of the invention, which is defined in the claims.

What is claimed is:

1. A pump drive head comprising:

a housing;

a main shaft comprising an outer tube and a liner tube, rotatably supported in the housing and connected to a pump driving rod, wherein the outer and liner tubes abut along a portion of their length and are separated along another portion of their length thereby forming an elongate tubular space;

a driving apparatus operatively connected to the main shaft;

a hydraulic pump operatively connected directly or indirectly to the main shaft;

a hydraulic circuit connected to the hydraulic pump, the hydraulic pump having a first and a second direction of operation, the first direction pumping little or no fluid through the hydraulic circuit, thereby providing a relatively low resistance to rotation of the main shaft, the second direction pumping fluid through the hydraulic circuit, thereby providing a relatively high resistance to rotation of the main shaft; and a standpipe coupled at one end to the housing, below the lower bearing, and received within the elongate tubular space between the outer and liner tubes of the main shaft.

2. A pump drive head as claimed in claim 1, wherein the hydraulic circuit includes a variable resistor.

3. A pump drive head as claimed in claim 2 wherein the variable resistor includes a variable orifice.

4. A pump drive head as claimed in claim 3 wherein the variable resistor includes a temperature sensitive variable orifice.

5. A pump drive head as claimed in claim 4 wherein the temperature sensitive variable orifice comprises a wax motor actuator.

6. A pump drive head as claimed in claim 4 wherein the first direction is clockwise and the second direction is counterclockwise.

7. A pump drive head as claimed in claim 1 wherein the hydraulic pump includes a first and a second intermeshing gear the first gear coupled to the main shaft for rotation therewith.

8. A pump drive head as claimed in claim 7, wherein the hydraulic pump includes a suction port for rotation in the second direction.

9. A pump drive head as claimed in claim 8 further comprising an internal fluid reservoir.

10. A pump drive head as claimed in claim 9 wherein the suction port between the first and second gears communicates with the internal fluid reservoir.

11. A pump drive head comprising:

a housing;

upper and lower bearings disposed in the housing;

a main shaft operatively connected to a driving apparatus and received in the upper and lower bearings, the main shaft including an outer tube and a liner tube, wherein the outer and liner tubes abut along a first portion of their length and are separated along a second portion of their length thereby forming an elongate tubular space; and a standpipe coupled at one end to the housing, below the lower bearing, and received within the elongate tubular space between the outer and liner tubes of the main shaft.

12. A pump drive head comprising:

a housing;

upper and lower bearings disposed in the housing;

a main shaft operatively connected to a driver apparatus and received in the upper and lower bearings, the main shaft including an outer tube and a liner tube, wherein the outer and liner tubes abut along a first portion of their length and are separated along a second portion of their length thereby forming an elongate tubular space;

a backspin preventer coupled to the main shaft; and a standpipe coupled at one end to the housing, below the lower bearing, and received within the elongated tubular space between the outer and liner tubes of the main shaft.

13. A pump drive head comprising:

a housing;

upper and lower bearings disposed in the housing;

a main shaft operatively connected to a driving apparatus received in the upper and lower bearings, the main shaft including an outer tube and a liner tube, wherein the outer and liner tubes abut along a first portion of their length and are separated along a second portion of their length thereby forming an elongate tubular space;

a standpipe coupled at one end to the housing, below the lower bearing, and received within the elongate tubular space between the outer and liner tubes of the main shaft;

a hydraulic pump including a hydraulic pump chamber disposed in the housing and communicating with the main shaft, a first gear disposed in the hydraulic pump chamber and coupled to the main shaft, a second gear disposed in the hydraulic pump chamber and intermeshing the first gear, and a suction port located between the first and second gears and operable for one direction of rotation of the main shaft; and a hydraulic circuit coupled to the suction port for resisting said one direction of rotation of the main shaft.

14. A pump drive head comprising:

a housing;

upper and lower bearings disposed in the housing;

a main shaft comprising an outer tube and an inner tube operatively connected to a driving apparatus and received in the upper and lower bearings, wherein the outer and liner tubes abut along a portion of their length are separated along another portion of their length thereby forming an elongate tubular space;

a hydraulic pump including a hydraulic pump chamber disposed in the housing and communicating with the main shaft, a first gear disposed in the hydraulic pump chamber and coupled to the main shaft, a second gear disposed in the hydraulic pump chamber and intermeshing the first gear, and a suction port located between the first and second gears and operable for one direction of rotation of the main shaft;

a hydraulic circuit coupled to the suction port for resisting said one direction of rotation of the main shaft; and a standpipe coupled at one end to the housing, below the lower bearing, and received within the elongate tubular space between the outer and liner tubes of the main shaft.

15. A drive head for use in driving an oil well downhole pump, comprising:

a housing;

upper and lower bearings disposed in the housing;

a shaft for connection to a driving apparatus and received in said upper and lower bearings for rotation therein, said shaft including:

concentric inner and outer tubular shaft members, said inner and outer shaft members being connected together at upper ends thereof and being spaced apart from said upper ends to lower ends thereof to define an annular chamber with a closed upper end, said outer tubular member being mounted in said upper and lower bearings, and a non-rotatable standpipe coupled at a lower end thereof to said housing below said lower bearing and received within said annular chamber between said inner and outer tubular members.

16. A drive head, as defined in claim 15, said standpipe including an annular plate removably connected to said housing and having a concentric bore and a pipe member secured to said annular plate and sized to be inserted into said annular chamber.

17. A drive head, as defined in claim 16, further including a seal disposed between the lower ends of said standpipe and said outer tubular member.

18. A drive head, as defined in claim 17, further including a seal disposed between an outer surface of said outer member and a bottom surface of said upper bearing.

19. A drive head, as defined in claim 18, further including a backspin retarder mounted in said housing and connected to said outer tubular shaft member for rotation therewith and for controlling reverse rotation of said shaft.

20. A drive head, as defined in claim 19, said backspin retarder including a hydraulic pump having:

a hydraulic pump chamber disposed in said housing and communicating with the main shaft, a first gear disposed in said hydraulic pump chamber and coupled to said main shaft, a second gear disposed in said hydraulic pump chamber in meshing engagement with said first gear, a suction port between the first and second gears and operable for one direction of rotation of said shaft; and a hydraulic circuit coupled to said suction port for resisting said one direction of rotation of the main shaft.

21. A drive head for driving a downhole pump in an oil well, comprising:

a housing having a fluid reservoir therein;

upper and lower bearing assemblies disposed in upper and lower ends, respectively, of said housing;

a shaft for connection to a drive motor, said shaft being mounted in said upper and lower bearings for rotation therein and extending through said reservoir, said shaft including concentric inner and outer tubular members; said inner and outer members being spaced apart and connected together at upper ends thereof to define an annular chamber with a closed upper end, said closed upper end being the upper end of said reservoir, said outer tubular member being mounted in said bearings;

a non-rotatable standpipe coupled at one end to said housing below said lower bearing and received within said annular chamber between said inner and outer members, said standpipe including an annular plate removably connected to said housing and having a concentric bore for receiving a shaft therethrough and a pipe member having a bottom end secured to said annular plate, said pipe member being sized to be inserted into said annular chamber with an upper end thereof positioned above the upper end of said reservoir; a first seal disposed between an outer surface of said pipe and said outer tubular member, a second seal disposed between an inner surface of said outer member and a bottom surface of said upper bearing;

a backspin retarder mounted in said reservoir and coupled to said shaft for controlling reverse rotation of said shaft, said backspin retarder including a hydraulic pump having:

a hydraulic pump chamber in said housing, said shaft extending into said pump chamber;

a first gear in the hydraulic pump chamber and connected to said shaft for rotation therewith;

a second gear in the hydraulic pump chamber for meshing engagement with said first gear;

a suction port in said pump chamber between said first and second gears and operable for one direction of rotation of said shaft and inoperable in the other direction of rotation of said shaft; and a hydraulic circuit coupled to the suction port for resisting said one direction of rotation of the main shaft.

* * * * *